United States Patent [19]

Ii et al.

[11] 4,414,162

[45] Nov. 8, 1983

[54] AIR VALVE TYPE TWIN COMPOUND CARBURETOR FOR ENGINES

[75] Inventors: Akira Ii; Mitunori Sasano; Michio Morishita, all of Toyota; Mikio Kuno, Aichi; Kunio Kadowaki, Obu, all of Japan

[73] Assignees: Toyota Jidosha Kogyo Kabushiki Kaisha, Toyota; Aisan Industry Co., Ltd., Obu, both of Japan

[21] Appl. No.: 346,992

[22] Filed: Feb. 8, 1982

[30] Foreign Application Priority Data

Oct. 30, 1981 [JP] Japan ..... 56-172947

[51] Int. Cl.[3] ..... F02M 13/04

[52] U.S. Cl. ..... 261/23 A; 261/50 A; 261/41 C; 123/DIG. 11

[58] Field of Search ..... 123/DIG. 11; 261/50 A, 261/23 A, 41 C

[56] References Cited

U.S. PATENT DOCUMENTS

| | | | |
|---|---|---|---|
| 3,272,483 | 9/1966 | Martin | 261/41 C |
| 3,284,060 | 11/1966 | Kalert, Jr. | 261/50 A |
| 3,794,004 | 2/1974 | Stultman | 261/50 A |
| 3,841,281 | 10/1974 | Mick | 261/50 A |
| 4,016,852 | 4/1977 | Konishi et al. | 123/DIG. 11 |
| 4,198,356 | 4/1980 | Takimoto | 123/DIG. 11 |
| 4,200,595 | 4/1980 | Dye | 261/52 |

*Primary Examiner*—Tim R. Miles

*Attorney, Agent, or Firm*—Finnegan, Henderson, Farabow, Garrett & Dunner

[57] ABSTRACT

An air valve type two-stage twin compound carburetor for an internal combustion engine comprises a carburetor body including a primary bore and a secondary bore, a primary throttle valve which is arranged in the primary bore so that it can be opened and closed, a secondary throttle valve which is arranged in the secondary throttle bore so that it can be opened and closed co-operatively with the opening and closing of the primary throttle valve after the primary throttle valve has been opened beyond a certain degree, and an air valve which is arranged in the secondary bore upstream of a secondary fuel nozzle disposed upstream of the secondary throttle valve, so that the air valve is opened and closed. The degree of opening of the air valve is regulated so as to be opened when the primary throttle valve is in the idle closing position or in the initial opening position.

3 Claims, 4 Drawing Figures

AIR VALVE TYPE TWIN COMPOUND CARBURETOR FOR ENGINES

BACKGROUND OF THE INVENTION (1) Field of the Invention

The present invention relates to an improvement in the carburetor of a spark-ignition internal combustion engine. More particularly, the present invention relates to an air valve type two-stage twin compound carburetor having an air valve on the secondary side.

(2) Description of the Prior Art

In a spark-ignition internal combustion engine provided with a carburetor, a phenomenon called "running-on" sometimes takes place. This occurs when the combustion chamber of the engine is hot and a large quantity of an air-fuel mixture is present in the carburetor. Fuel vapor is generated because of the high temperature of the fuel. The rich air-fuel mixture is supplied to the combustion chamber from a primary idle port or a low-speed port after the engine ignition switch has been turned off, but while the engine is still being rotated by the force of inertia. Even though the ignition is off combustion occurs due to natural ignition and rotation of the engine is continued. This phenomenon is called "running-on". When the throttle valve is not smoothly returned to the closed position due to the presence of foreign matter or the like, a negative pressure is produced in the main nozzle, and fuel is injected, causing a large quantity of an air-fuel mixture having a rich air-fuel ratio to be supplied to the engine. This sometimes causes the phenomenon of "running-on" to be continued for a long time. Combustion by such a "running-on" phenomenon is incomplete combustion, and if the "running-on" is continued for a long time, in the case of a vehicle having an exhaust gas-cleaning catalyst attached to an exhaust pipe, the catalyst is abnormally heated by the reaction of unburnt gas on the catalyst and fusion loss of the catalyst is likely to occur. Moreover, this "running-on" phenomenon is not preferred from the viewpoint of the fuel economy.

In the conventional carburetor, a valve member for opening and closing a fuel passage of the carburetor is arranged as a means for preventing the occurrence of the running-on phenomenon, and the fuel passage is closed, simultaneously when the ignition is turned off, to stop the fuel from being supplied to the engine. An electromagnetic valve is often used as the valve member for opening and closing the fuel passage. However, the electromagnetic valve is relatively expensive, and, if the electromagnetic valve is attached to the fuel passage, when the electromagnetic valve gets out of order, the driving characteristics of the vehicle are often degraded. This is one disadvantage of using such an electromagnetic valve.

In a twin compound carburetor having a primary system and a secondary system, a fuel nozzle is sometimes arranged in the secondary low-speed system, so as to cope with a bad return of the secondary throttle valve, which is likely to occur. Furthermore, in an air valve type twin compound carburetor, in which an air valve is arranged in an air introduction zone above a small venturi of the secondary system and a closing moment is imposed on the air valve, the negative pressure of the secondary system is increased by the choke effect of the air valve to increase the injection response of the fuel. In such a carburetor, if, on turning ignition off, closure of the secondary throttle valve is hindered, for some reason or other, fuel is caused to flow out of the fuel nozzle by the choke effect of the air valve, and running-on is promoted by the thus enriched air-fuel mixture. Therefore, in this air valve type carburetor, it is necessary to prevent the fuel from flowing out in the secondary main system simultaneously with the ignition being turned off, and therefore, the structure of the carburetor inevitably becomes complicated.

SUMMARY OF THE INVENTION

Under such background, it is a primary object of the present invention to provide an air valve type two-stage twin compound carburetor, in which fuel flowing out from a secondary main nozzle is stopped when the ignition of an internal combustion engine is turned off, whereby the occurrence of the running-on phenomenon in the engine can be prevented assuredly.

Another object of the present invention is to provide an air valve type carburetor in which occurrence of the running-on phenomenon can be prevented assuredly by a simple and cheap structure.

Still another object of the present invention is to provide an air valve type carburetor for an internal combustion engine having a catalyst arranged in the exhaust system for cleaning the exhaust gas, in which the problem of fusion loss of the catalyst can be solved.

In accordance with the present invention, these objects can be attained by an air valve type two-stage twin compound carburetor for an internal combustion engine, which comprises a carburetor body, including a primary bore and a secondary bore; a primary throttle valve, which is arranged in the primary bore so that it can be opened and closed; a secondary throttle valve which is arranged in the secondary bore so that it can be opened and closed co-operatively with the opening and closing of said primary throttle valve, after said primary throttle valve has been opened beyond a certain opening degree; and an air valve, which is arranged in the secondary bore upstream of a secondary fuel nozzle, disposed upstream of said secondary throttle valve, so that said air valve can be opened and closed, wherein the degree of the opening of said air valve is regulated by the idle closing position of said primary throttle valve or the initial opening degree thereof.

A preferred embodiment of the present invention is characterized in that a first lever, co-operating with the primary throttle valve, is rotatably mounted on a shaft to which said air valve is fixed and a second lever, capable of abutting on said first lever, is secured to said shaft, so that the first lever is caused to abut on the second lever at a position close to the idling position of the primary throttle valve, whereby said air valve is opened beyond the predetermined opening degree.

BRIEF DESCRIPTION OF THE DRAWINGS

The present invention will now be described in detail with reference to the embodiments illustrated in the accompanying drawings; wherein.

DETAILED DESCRIPTION OF PREFERRED EMBODIMENT

Figure 1:
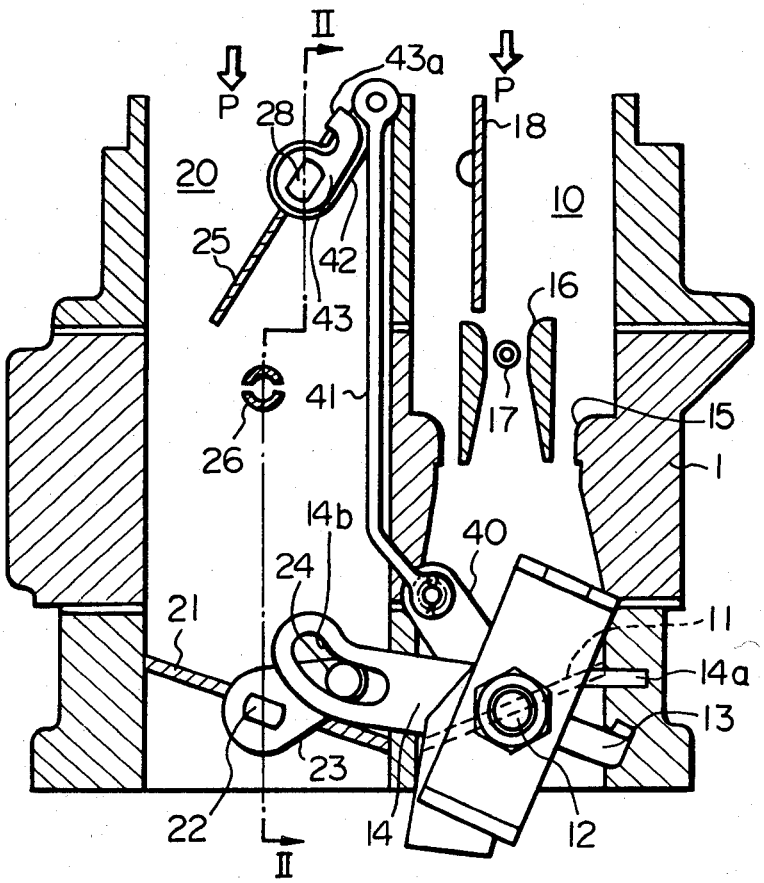
FIG. 1 is a sectional view showing the carburetor of the present invention in the state where the internal combustion engine is idling.
Figure 2:
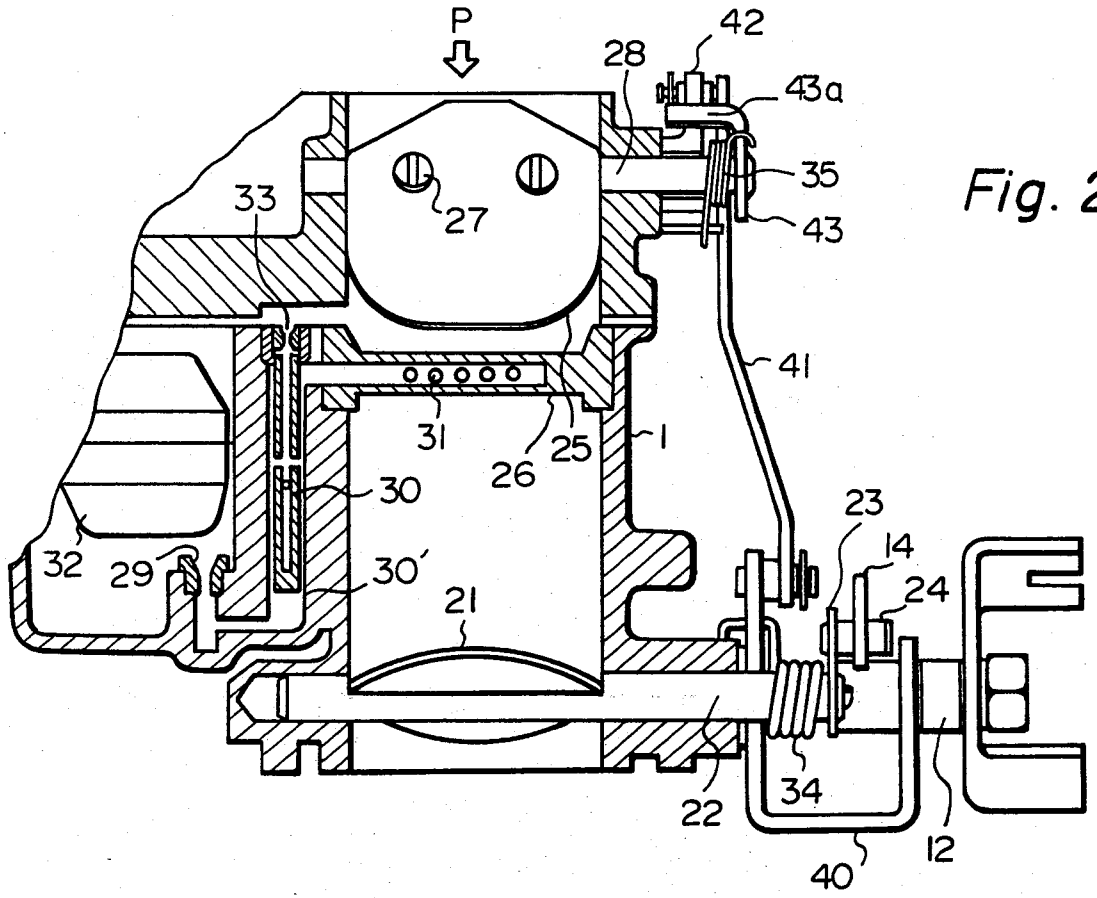
FIG. 2 is a view showing the section taken along the line II—II in FIG. 1.

FIG. 1 is a sectional view showing an air valve type two-stage twin compound carburetor according to one embodiment of the present invention, and FIG. 2 is a view showing the section taken along the line II—II in FIG. 1. A carburetor body 1 has a primary suction passage (bore) 10 and a secondary suction passage (bore) 20, and a primary throttle valve 11 and a secondary throttle valve 21 are arranged in these bores 10 and 20, respectively. These throttle valves 11 and 21 are secured to shafts 12 and 22 which are rotatably arranged to the body 1 to cross the bores 10 and 20, respectively, so that the respective bores 10 and 20 can be opened and closed. A lever 13 is secured to the shaft 12 of the primary throttle valve 11 and a kick lever 14 is rotatably mounted on the shaft 12 in such a manner that, when the primary throttle valve 11 is opened in the counterclockwise direction by a predetermined angle from the closing position shown in FIG. 1, the lever 13 falls in abutting contact with one end 14*a* of the kick lever 14. A long slot 14*b* is formed on the other end of the kick lever 14. A pin 24 of lever 23, secured to the shaft 22 of the secondary throttle valve 21, is engaged with the long slot 14*b*. In this arrangement, the kick lever 14 and the secondary throttle valve 21 are rotated in directions opposite to each other, but co-operatively with each other.

In the carburetor according to the embodiment shown in FIGS. 1 and 2, the primary system is a fixed venturi system and comprises a primary large venturi 15 and a primary small venturi 16 arranged upstream of the primary throttle valve 11. A primary main nozzle 17 is disposed in the vicinity of the primary small venturi 16 and fuel for the primary system is injected from this nozzle 17. Reference numeral 18 represents a choke valve arranged upstream of the primary main nozzle 17.

On the other hand, the secondary system is not a fixed venturi system, but a kind of a variable venturi system, including an air valve 25. More specifically, a secondary main nozzle 26, comprising a tubular member having a plurality of jet holes 31, is arranged upstream of the secondary throttle valve 21 disposed within the secondary bore 20, and the air valve 25 is arranged upstream of the secondary main nozzle 26. The air valve 25 is opened and closed according to the quantity of air sucked into the secondary bore 20, and by thus changing the sectional area of the passage of the secondary bore 20, the function of a kind of a variable venturi can be exerted. The air valve 25 is secured to a shaft 28 by a screw 27 (see FIG. 2). This shaft 28 is rotatably mounted on the body 10 to cross the secondary bore 20. The shaft 28 of the air valve 25 is connected through a link, or the like (not shown), to a metering needle (not shown) co-operating with a secondary main jet 29 (see FIG. 2), and the quantity of the fuel to be supplied to the secondary system is metered by this metering needle. Referring to FIG. 2, the metered fuel is passed through a secondary main well 30' from the secondary main jet 29 and injected into the secondary bore 20 from a jet hole 31. In FIG. 2, reference numerals 30, 32 and 33 represent a secondary emulsion tube, a float in a float chamber and a secondary main air bleed, respectively. Furthermore, in FIG. 2, reference numeral 34 represents a spring for imparting a closing force to the secondary throttle valve 21, and reference numeral 35 represents a spring for imparting a closing force to the air valve 25, and these valves are urged to full-close positions by these springs. Incidentally, a spring is also arranged to impart a closing force to the primary throttle valve 11 (see FIG. 1), although this spring is not shown in the drawings.

Referring to FIGS. 1 and 2, a lever 40 is secured to the shaft 12 of the primary throttle valve 11, and one end of a connecting rod 41 is pivoted on the top end of the lever 40. Incidentally, the lever 40 may be integrated with the lever 13. A first lever (air valve lever) 42 is rotatably mounted on the shaft 28 of the air valve 25 of the secondary system, and the other end of the connecting rod 41 is pivoted on the top end of the first lever 42. A second lever (air valve opener) 43 is secured to the shaft 28 of the air valve 25, and a part 43*a* of the second lever 43 is extended in the axial direction of the shaft 28, so that the first lever 42 can abut on this part 43*a*.

The operation of the carburetor of the present invention will now be described. Incidentally, P in FIGS. 1 through 3 represents the direction of flow of the sucked air.

FIG. 1 (FIG. 2) shows the state where the engine is idling. The degree of the opening of the primary throttle valve 11 is relatively small, and the secondary throttle valve 21 is in the full-closed state. In this case, the first lever (air valve lever) 42 is turned in the counterclockwise direction, to the position shown in FIG. 1, by the connecting rod 41 connected to the lever 40, and the air valve 25 is forcibly opened to a certain degree through the second lever (air valve opener) 43. Incidentally, the force of opening the air valve 25 is due to the closing force of the primary throttle valve 11. If the ignition is turned off in this state, since the air valve 25 is kept open, even though the secondary throttle valve 21 is not smoothly returned, for some reason or other, but is opened to a certain degree, the force of the negative pressure acting on the secondary main nozzle 26 is small and injection of the fuel can be prevented, with the result that occurrence of the running-on phenomenon can be prevented.

Figure 3:
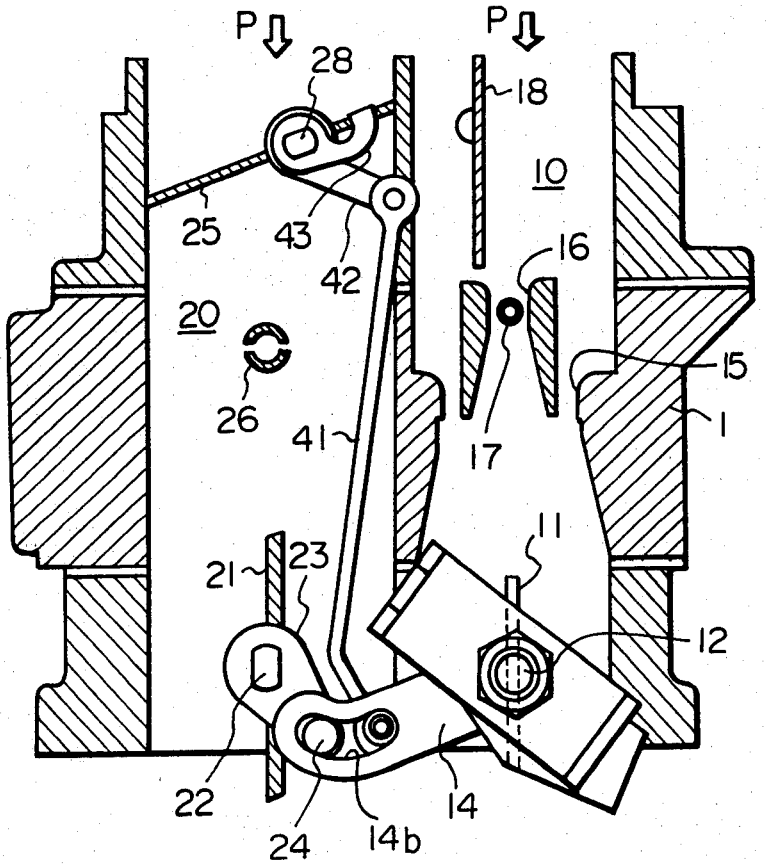
FIG. 3 is a sectional view similar to FIG. 1, which is given to illustrate the operation of the carburetor of the present invention; and, FIG. 4 is a diagram illustrating the allowable degree of the opening of the air valve.

FIG. 3 illustrates the state where the primary throttle valve 11 and secondary throttle valve 21 are fully opened. In this case, the first lever (air valve lever) 42 is turned in the clockwise direction by the connecting rod 41, connected to the lever 40. For the sake of explanation, the state where the air valve 25 is fully closed is shown. Actually, however, the air valve 25 is freely movable between the full-closed position and the full-open position. In other words, the first lever 42 is turned in the clockwise direction and separated from the operation region of the second lever 43. In this state, the flow rate of sucked air is increased and decreased according to the rotation of the engine and the pressure imposed on the air valve 25 is, accordingly, increased and decreased, and the air valve 25 performs a normal opening-closing operation.

Figure 4:
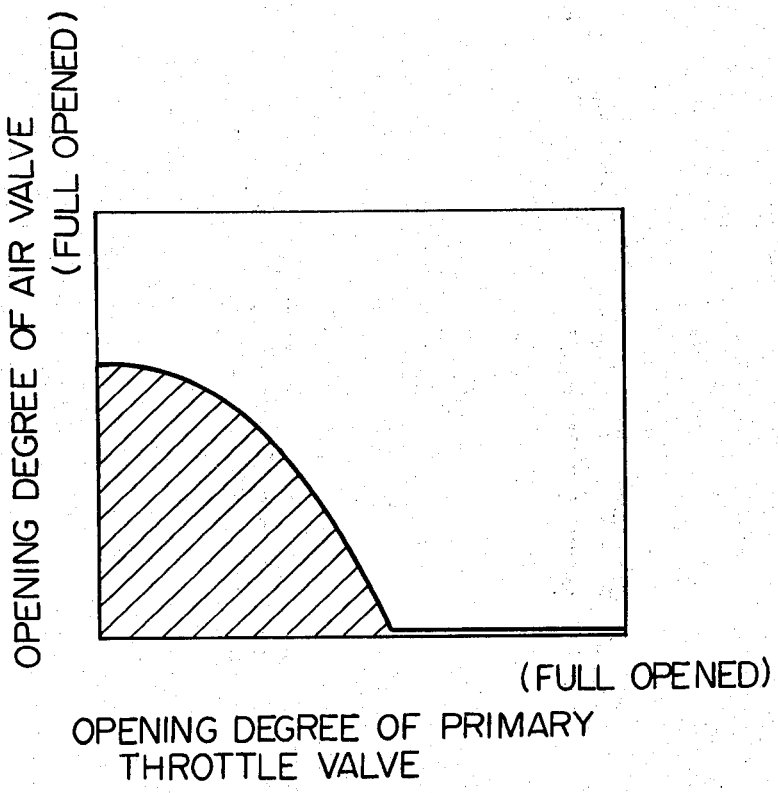

FIG. 4 illustrates an example of the relation between the opening degree of the primary throttle valve 11 and the allowable opening degree of the air valve 25 in the above-mentioned embodiment. The air valve is forcibly opened if the opening of the primary throttle valve is up to a certain level, and if the opening of the throttle valve exceeds this level, the air valve is maintained in the free state and is allowed to perform normal a opening-closing operation. Namely, in FIG. 4, the hatched portion indicates the region where the degree of the opening of the air valve is restricted.

According to the present invention, by causing the air valve to perform an opening-closing operation by the link mechanism co-operating with the primary throttle valve, occurrence of the running-on phenomenon of the engine can be prevented without any bad influence on the normal operation of the air valve, with the result that damage to the engine and abnormal heating of the catalyst can be prevented. Therefore, the present invention is very advantageous from the industrial viewpoint.

We claim:

1. An air-valve type two-stage twin compound carburetor for an internal combustion engine, comprising:

a carburetor body including a primary bore and a secondary bore;

a primary throttle valve which is arranged in the primary bore so that it can be opened and closed;

a secondary throttle valve which is arranged in the secondary bore so that it can be opened and closed cooperatively with the opening and closing of said primary throttle valve, after said primary throttle valve has been opened beyond a certain degree;

an air valve which is arranged in the secondary bore upstream of a secondary fuel nozzle disposed upstream of said secondary throttle valve so that said air valve can be opened and closed; and means for regulating the opening degree of said air valve, wherein said means comprises a first lever rotatably mounted on an air valve shaft to which said air valve is fixed, a second lever, capable of abutting on said first lever, being secured to said air valve shaft, a third lever fixed to a primary throttle shaft to which said primary throttle valve is fixed, and a connecting rod pivotally connected at one thereof to a free end of said third lever, and the other end of said connecting rod being pivotally connected to a free end of said first lever, so that the first lever is caused to abut on the second lever so as to open said air valve beyond a predetermined opening degree thereof, when said primary throttle valve is closed at a position close to the idling position thereof.

2. An air-valve type two-stage twin compound carburetor for an internal combustion engine, comprising:

(a) a carburetor body including a primary bore and a secondary bore;

(b) a primary throttle valve fixed to a shaft and disposed in said primary bore for movement between open and closed positions responsive to force applied to said primary throttle shaft;

(c) a secondary throttle valve fixed to a shaft and disposed in said secondary bore for movement between open and closed positions;

(c) means interconnecting said primary and secondary throttle valves for synchronizing opening and closing movement thereof after said primary throttle valve has opened beyond a predetermined degree;

(e) a secondary fuel nozzle disposed in said secondary bore upstream of said secondary throttle valve;

(f) an air valve fixed to a shaft and disposed in said secondary bore upstream of said secondary fuel nozzle for movement between open and closed positions; and (g) linkage means interconnecting said primary throttle valve and said air valve for applying the force closing said primary throttle valve to said air valve to simultaneously forcibly open said air valve to a predetermined position when said primary throttle valve is closed to proximate the position for idling said engine, said linkage means permitting free movement of said air valve between open and closed positions when said primary throttle valve has opened beyond a predetermined degree.

3. The carburetor of claim 2 wherein said linkage means comprises:

(a) a first lever rotatably mounted on said air valve shaft;

(b) a second lever secured to said air valve shaft and being capable of abutting said first lever;

(c) a third lever fixed to said primary throttle shaft; and (d) a connecting rod pivotally connected at one end thereof to a free end of said third lever and pivotally connected at the other end thereof to a free end of said first lever, said connecting rod transmitting force closing said primary throttle to said first lever to abut said second lever and to rotate said air valve to a predetermined open position when said primary throttle valve is closed to proximate the position for idling said engine.

* * * * *